US010451069B2

(12) United States Patent
Matsui

(10) Patent No.: US 10,451,069 B2
(45) Date of Patent: Oct. 22, 2019

(54) SCROLL COMPRESSOR

(71) Applicant: Mitsubishi Electric Corporation, Tokyo (JP)

(72) Inventor: Tomokazu Matsui, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 225 days.

(21) Appl. No.: 15/101,500

(22) PCT Filed: Jan. 22, 2014

(86) PCT No.: PCT/JP2014/051206
§ 371 (c)(1),
(2) Date: Jun. 3, 2016

(87) PCT Pub. No.: WO2015/111146
PCT Pub. Date: Jul. 30, 2015

(65) Prior Publication Data
US 2016/0319818 A1 Nov. 3, 2016

(51) Int. Cl.
*F04C 29/00* (2006.01)
*F04C 18/02* (2006.01)
(Continued)

(52) U.S. Cl.
CPC ..... *F04C 29/0007* (2013.01); *F04C 18/0215* (2013.01); *F04C 18/0261* (2013.01);
(Continued)

(58) Field of Classification Search
CPC ..... F04C 29/0007; F04C 18/0261; F04C 18/0284; F04C 27/005; F04C 27/007
(Continued)

(56) References Cited

U.S. PATENT DOCUMENTS 4,453,899 A * 6/1984 Hiraga ..... F01C 1/0215 277/399
4,673,339 A * 6/1987 Hayano ..... F04C 18/0215 418/15
(Continued)

FOREIGN PATENT DOCUMENTS

CN 1245257 A 2/2000
CN 1940296 A 4/2007
(Continued)

OTHER PUBLICATIONS

Office Action dated Apr. 1, 2017 issued in corresponding CN patent application No. 201480072375.7 (and English translation).
(Continued)

*Primary Examiner* — Deming Wan
(74) *Attorney, Agent, or Firm* — Posz Law Group, PLC

(57) ABSTRACT

A scroll compressor includes a sealed container, a fixed scroll that is disposed within the sealed container and includes a base plate and a scroll lap extending from a lower surface of the base plate, an orbiting scroll that is disposed within the sealed container and includes a base plate and a scroll lap extending from an upper surface of the base plate, a compression chamber defined by engagement of the scroll lap of the fixed scroll and the scroll lap of the orbiting scroll, and an injection passage that extends through the base plate of the fixed scroll from an upper surface of the base plate to the lower surface of the base plate and communicates with the compression chamber through an opening port. The scroll lap of the fixed scroll defining the compression chamber is at least partly located inside the opening port in plan view of the fixed scroll.

6 Claims, 5 Drawing Sheets

(51) Int. Cl.
*F04C 27/00* (2006.01)
*F04C 29/12* (2006.01)
*F04C 23/00* (2006.01)

(52) U.S. Cl.
CPC ..... *F04C 18/0284* (2013.01); *F04C 23/008* (2013.01); *F04C 27/001* (2013.01); *F04C 27/005* (2013.01); *F04C 29/12* (2013.01); *F04C 2240/30* (2013.01)

(58) Field of Classification Search
USPC ..... 418/55.1, 55.2, 55.4, 57
See application file for complete search history.

(56) References Cited

U.S. PATENT DOCUMENTS 4,717,314 A * 1/1988 Sato ..... F04C 18/0215 417/310
5,562,434 A * 10/1996 Makino ..... F04C 27/005 418/142
6,196,816 B1 3/2001 Lifson et al.
2007/0031275 A1* 2/2007 Nogawa ..... F04C 29/0021 418/55.2
2008/0107555 A1* 5/2008 Lifson ..... F04C 29/128 418/55.1
2009/0257900 A1* 10/2009 Beers ..... F04C 18/0215 418/55.2

FOREIGN PATENT DOCUMENTS

EP 0 980 978 A1 2/2000
EP 2 280 172 A1 2/2011
JP 07-317686 A 12/1995
JP H10-037868 A 2/1998
JP 2003-120555 A 4/2003
JP 2006-112376 A 4/2006
JP 2012-247105 A 12/2012
JP 2013-130141 A 7/2013
WO 2006/103821 A1 10/2006

OTHER PUBLICATIONS

Office Action dated Nov. 14, 2017 issued in corresponding CN patent application No. 201480072375.7 (and English translation).
International Search Report of the International Searching Authority dated Apr. 28, 2014 for the corresponding international application No. PCT/JP2014/051206 (and English translation).
Japanese Office Action dated Sep. 6, 2016 in the corresponding JP application No. 2015-558629. (English translation attached).
Extended European Search Report dated Apr. 3, 2019 issued in corresponding EP patent application No. 14879980.2.

* cited by examiner

SCROLL COMPRESSOR

CROSS REFERENCE TO RELATED APPLICATION

This application is a U.S. national stage application of International Application No. PCT/JP2014/051206 filed on Jan. 22, 2014, the disclosure of which is incorporated herein by reference.

TECHNICAL FIELD

The present invention relates to a scroll compressor.

BACKGROUND ART

In compressing gas refrigerant, the pressure of the refrigerant rises and the temperature thereof also rises. In a refrigeration cycle, the pressure is increased to a target high pressure. To eliminate or reduce a likelihood that the temperature will automatically rise too high, a method of injecting liquid refrigerant and using heat of evaporation of the refrigerant to reduce the temperature is used.

A scroll compressor includes a fixed scroll including a base plate and a scroll lap and an orbiting scroll including a base plate and a scroll lap. The orbiting scroll is allowed to orbit. The scroll laps of the fixed scroll and the orbiting scroll engage with each other, thus defining compression chambers. The compression chambers include an intermediate chamber for reducing the volume of low pressure gas taken such that the pressure of the gas is increased to a target high pressure before the gas is discharged.

Typically, the intermediate chamber is at an intermediate pressure between the low pressure of the taken refrigerant and the target high pressure. Low temperature, high pressure liquid refrigerant is injected into the intermediate chamber through an injection passage, thus reducing the temperature of the high pressure gas to be discharged from the compressor. Typically, the above-described injection passage extends through the base plate of the fixed scroll from a rear surface of the base plate toward the scroll lap of the fixed scroll.

A known scroll compressor includes a fixed scroll, an orbiting scroll, and a seal for sealing a clearance between a lower surface (lap bottom) of a base plate of the fixed scroll and the tip of a scroll lap of the orbiting scroll (refer to Patent Literature 1, for example).

CITATION LIST

Patent Literature

Patent Literature 1: Japanese Unexamined Patent Application Publication No. 10-37868 (pp. 4-5, FIG. 4).

SUMMARY OF INVENTION

Technical Problem

In the scroll compressor disclosed in Patent Literature 1, when refrigerant is injected into an intermediate chamber, the seal may close at least part of an injection passage depending on the orbit angle of the orbiting scroll, Furthermore, if the seal closes the injection passage, the seal may be depressed upon receiving a pressure caused by an injection flow. Disadvantageously, compressed gas may leak to a low-pressure side through a clearance formed by the seal, thus causing loss of compression.

In particular, a compressor for low temperature purposes has a low suction pressure, resulting in a large difference between the suction pressure and the pressure in the intermediate chamber. The amount of compressed gas leaking through a clearance formed by the seal may accordingly be increased, thus causing the loss of compression.

In addition, an edge of an opening port of the injection passage may damage the seal closing the injection passage. If such an action is repeated for a long period, the seal will wear and the compressed gas will leak, thus causing the loss of compression.

In particular, under pressure conditions where an operation can be performed without injection, the seal may enter an injection hole. Disadvantageously, the seal may be broken into pieces and the pieces may be caught by compressing parts, thus causing a failure of the compressor.

The present invention has been made in consideration of the above-described problems, and is directed to a scroll compressor capable of injecting refrigerant into an intermediate chamber without adversely affecting a sealing function of a seal.

Solution to Problem

The present invention provides a scroll compressor including a sealed container, a fixed scroll that is disposed within the sealed container and includes a base plate and a scroll lap extending from a lower surface of the base plate, an orbiting scroll that is disposed within the sealed container and includes a base plate and a scroll lap extending from an upper surface of the base plate, a compression chamber defined by engagement of the scroll lap of the fixed scroll and the scroll lap of the orbiting scroll, and an injection passage that extends through the base plate of the fixed scroll from an upper surface of the base plate to the lower surface of the base plate and communicates with the compression chamber through an opening port. The scroll lap of the fixed scroll defining the compression chamber is at least partly located inside the opening port in plan view of the fixed scroll.

Advantageous Effects of Invention

According to the present invention, in plan view of the fixed scroll, the scroll lap of the fixed scroll defining the compression chamber is at least partly located inside the opening port. Consequently, refrigerant can be injected into an intermediate chamber without adversely affecting a sealing function of a seal.

DESCRIPTION OF EMBODIMENTS

Embodiment 1

Figure 1:
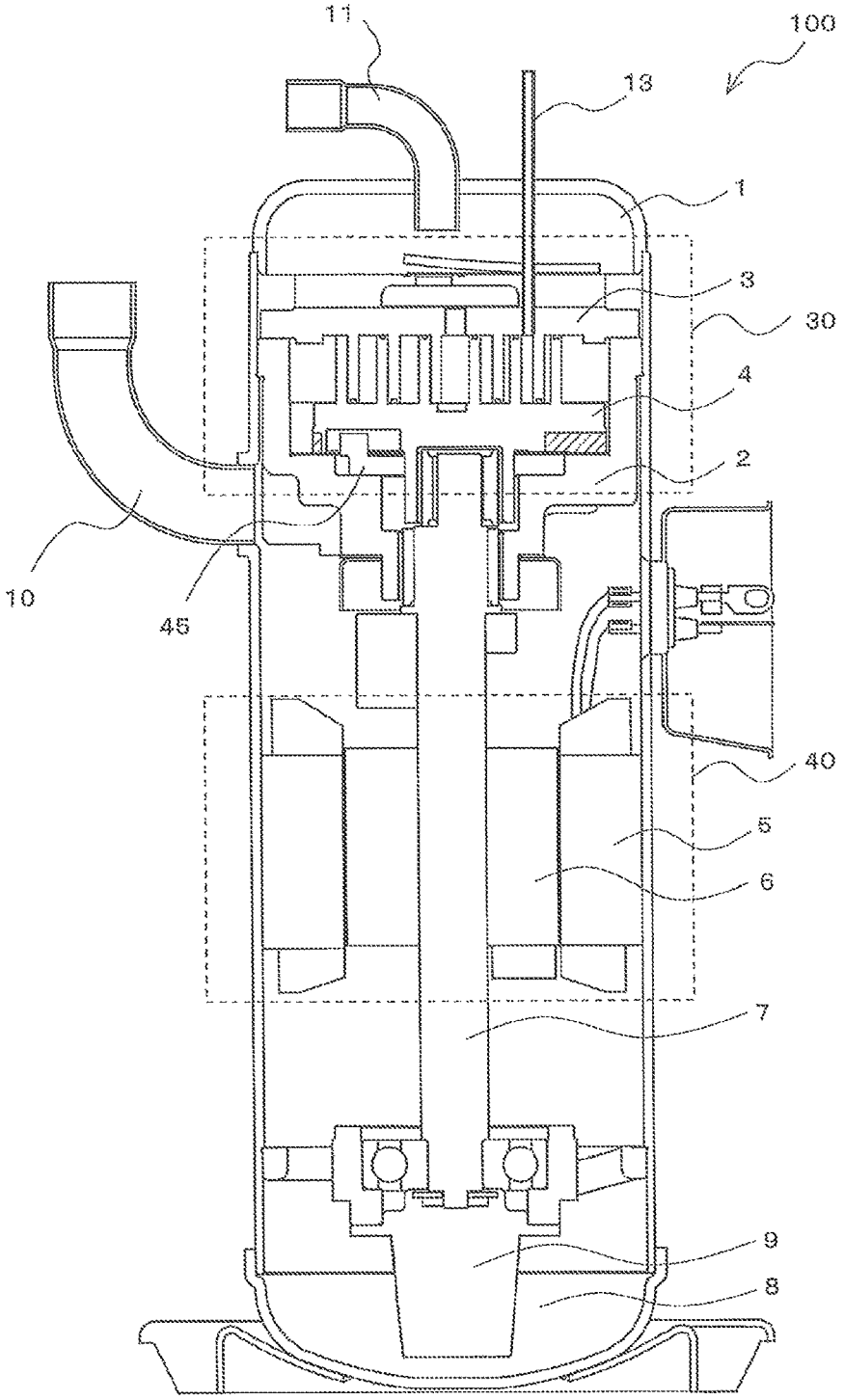
FIG. 1 is a longitudinal sectional view of the configuration of a compressor 100 according to Embodiment 1 of the present invention.
Figure 2:
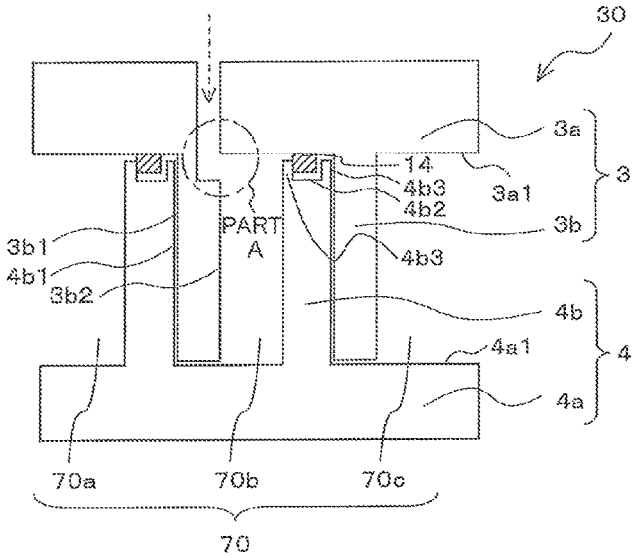
FIG. 2 is a longitudinal sectional view illustrating an injection passage configuration of the compressor 100 according to Embodiment 1 of the present invention.
Figure 3:
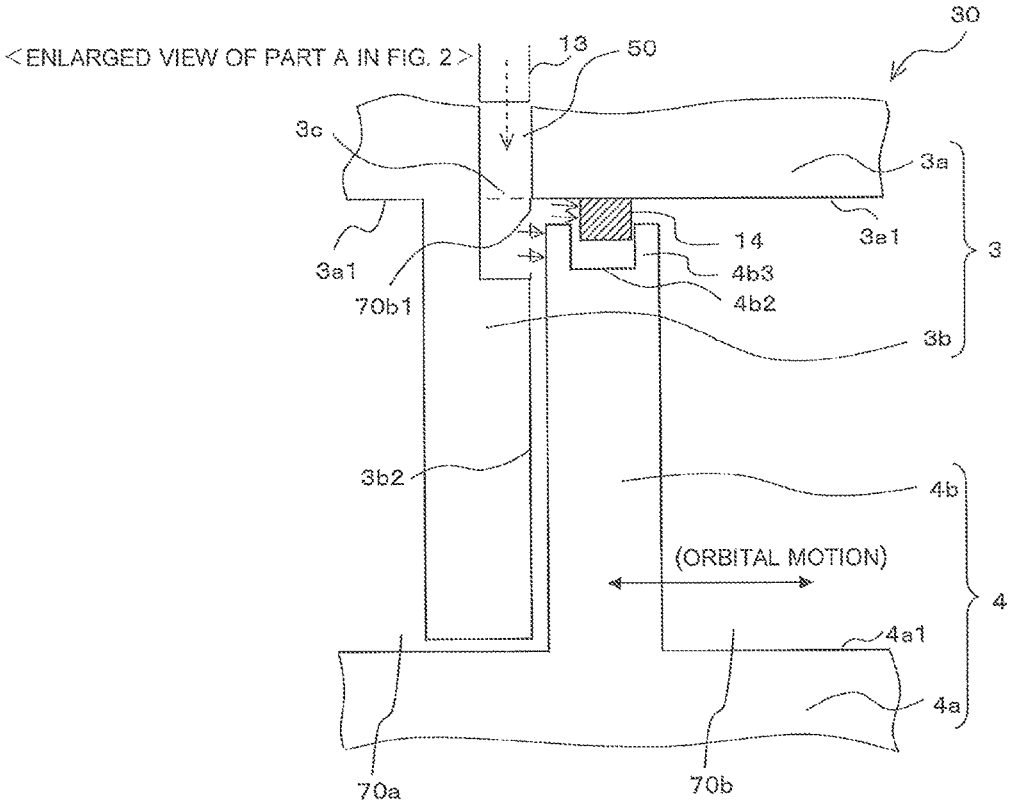
FIG. 3 is an enlarged view of essential part of the injection passage configuration of the compressor 100 according to Embodiment 1 of the present invention.

FIG. 1 is a longitudinal sectional view of the configuration of a compressor 100 according to Embodiment 1 of the present invention. FIG. 2 is a longitudinal sectional view illustrating an injection passage configuration of the compressor 100 according to Embodiment 1 of the present invention. FIG. 3 is an enlarged view of essential part of the injection passage configuration of the compressor 100 according to Embodiment 1 of the present invention.

FIG. 1 illustrates a typical internal structure of a scroll compressor. As illustrated in FIG. 1, the compressor 100 includes a sealed container 1, a frame 2, a main shaft 7, a reservoir 8, a pump 9, an injection pipe 13, a scroll compressing unit 30 disposed in upper part of the compressor 100, a motor driving unit 40 disposed in middle part of the compressor 100, and an Oldham ring 45.

The sealed container 1 includes a suction pipe 10 through which gas refrigerant is taken into the sealed container 1 and a discharge pipe 11 through which compressed gas refrigerant is discharged. The frame 2 is a member for retaining a fixed scroll 3, which will be described later. The main shaft 7, which has therein an oil pump hole (not illustrated) extending axially, is a member for supplying oil to sliding parts. The reservoir 8, which is disposed under the motor driving unit 40, is a space for storing lubricating oil. The pump 9, which is attached to a lower end of the main shaft 7, is a member for sucking up the lubricating oil stored in the reservoir 8. The injection pipe 13 is a pipe for supplying the refrigerant to the scroll compressing unit 30. Examples of the refrigerant to be injected include R22 and R32.

The scroll compressing unit 30 includes the fixed scroll 3 including a base plate 3*a* (FIG. 2) retained by the frame 2 within the sealed container 1 and an orbiting scroll 4 including a base plate 4*a* (FIG. 2). The orbiting scroll 4 is allowed to orbit. The scroll compressing unit 30 includes therein a plurality of compression chambers 70 (FIG. 2). The compression chambers 70 will be described in detail later.

The motor driving unit 40 includes a stator 5 fixed within the sealed container 1 and a rotor 6 fixed to the main shaft 7 so as to face the stator 5. The main shaft 7 is engaged with a bearing on a rear surface of the orbiting scroll so that rotation power can be transmitted to the compressing unit.

The Oldham ring 45 is disposed so as to engage with both a groove (not illustrated) on the frame 2 and a groove (not illustrated) on the rear surface of the orbiting scroll 4. This inhibits rotation of the orbiting scroll 4 and permits only orbital motion of the orbiting scroll 4.

An operation will now be described.

When power is supplied to the stator 5 from an external power supply, the rotor 6 rotates, so that power is transmitted to the orbiting scroll 4 through the main shaft 7. The orbiting scroll 4, whose rotation is inhibited by the Oldham ring 45, accordingly starts orbital motion.

The gas refrigerant sucked through the suction pipe 10 is successively taken into the compression chambers 70. Suction, compression, and discharge are repeated. The lubricating oil stored in the reservoir 8 is pumped by rotation of the main shaft 7 and is then supplied to the sliding parts. After that, the lubricating oil returns to the lower part of the sealed container 1.

When the temperature of the gas refrigerant to be discharged is high, liquid refrigerant is injected into an intermediate chamber 70*b* through the injection pipe 13. Typically, the liquid refrigerant to be injected is at a higher pressure than the target compression chamber 70. The injection is achieved using a pressure difference.

As illustrated in FIG. 2, the scroll compressing unit 30 includes the fixed scroll 3 and the orbiting scroll 4. The fixed scroll 3 includes the base plate 3*a* having a lap bottom surface 3*a*1 and a scroll lap 3*b* extending from a lower surface (lap bottom surface 3*a*1) of the base plate 3*a*. The orbiting scroll 4 includes the base plate 4*a* having a lap bottom surface 4*a*1 and a scroll lap 4*b* extending from an upper surface (lap bottom surface 4*a*1) of the base plate 4*a*. In FIG. 2, a dotted-line arrow indicates a refrigerant injection direction.

The scroll lap 3*b* has a scroll flank 3*b*1, a lap flank 3*b*2, and a tip facing the orbiting scroll 4. The scroll lap 4*b* has a scroll flank 4*b*1, a groove 4*b*2, and a tip facing the fixed scroll 3. The groove 4*b*2 is longitudinally recessed from the tip of the scroll lap 4*b* of the orbiting scroll 4 toward a base of the scroll lap 4*b*. The scroll lap 4*b* includes raised portions 4*b*3 defined by the groove 4*b*2. The groove 4*b*2 receives a seal 14.

The fixed scroll 3 and the orbiting scroll 4 are combined such that the scroll lap 3*b* and the scroll lap 4*b* engage with each other. Consequently, the lap bottom surface 3*a*1 faces the lap bottom surface 4*a*1 and the scroll flank 3*b*1 contacts the scroll flank 4*b*1, thus defining the compression chambers 70. The compression chambers 70 include a low pressure chamber 70*a*, the intermediate chamber 70*b*, and a high pressure chamber 70*c* in order of increasing pressure.

The seal 14 is a sealing member that automatically floats due to the pressure difference between the adjacent compression chambers after compression starts and comes into continuous contact with the lap bottom surface of the opposing scroll to achieve sealing. The seal 14, which is received in the groove 4*b*2, is a member movable between the groove 4*b*2 and the lower surface (lap bottom surface 3*a*1) of the base plate 3*a* of the fixed scroll 3. The seal 14 in the groove 4*b*2 of the orbiting scroll 4 hermetically seals the compression chambers 70.

As illustrated in FIG. 3, the base plate 3*a* of the fixed scroll 3 has an injection passage 50 extending from a rear surface of the base plate 3*a* to the scroll lap 3*b*. In other words, the injection passage 50 is formed so as to extend through the base plate 3*a* of the fixed scroll 3 from an upper surface of the base plate 3*a* to the lower surface thereof. The injection passage 50 is connected to the injection pipe 13 so that the refrigerant can be directly injected into the intermediate chamber 70*b*. Since the base plate 3*a* has the injection passage 50 as described above, the base plate 3*a* has an opening port 3*c* in the lower surface. In FIG. 3, full-line arrows indicate a direction in which force acts on the seal 14. In addition, the orbiting scroll 4 orbits horizontally as illustrated in FIG. 3.

In plan view of the fixed scroll 3, the scroll lap 3*b* of the fixed scroll 3 defining the intermediate chamber 70*b* is at least partly located inside the opening port 3*c*. Furthermore, an inner side surface of the raised portion 4*b*3 located adjacent to the injection passage 50 is located outside the opening port 3*c*.

Figure 4:
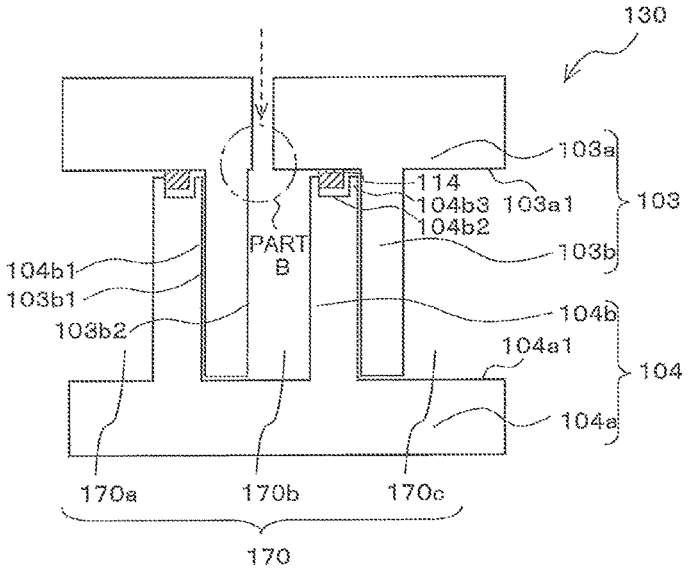
FIG. 4 is a longitudinal sectional view illustrating an injection passage configuration of a compressor according to Comparative Example.
Figure 5:
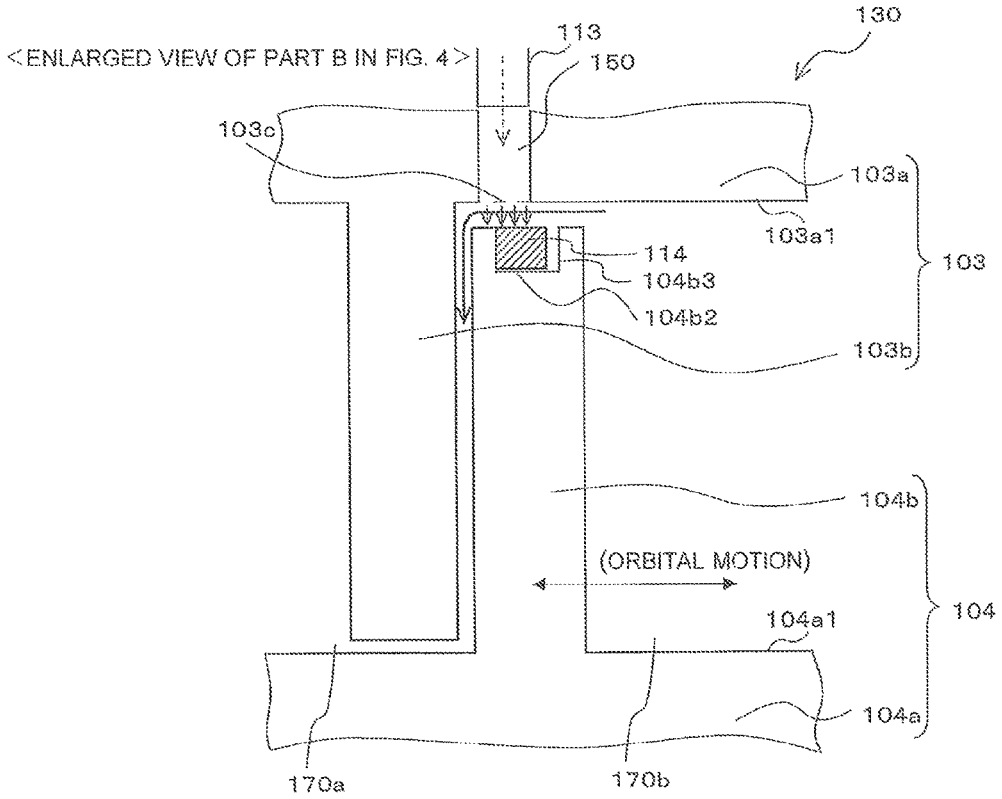
FIG. 5 is an enlarged view of essential part of the injection passage configuration of the compressor according to Comparative Example.

FIG. 4 is a longitudinal sectional view illustrating an injection passage configuration of a compressor according to Comparative Example. FIG. 5 is an enlarged view of essential part of the injection passage configuration of the compressor according to Comparative Example. The structure of a scroll compressing unit 130 of the compressor according to Comparative Example will now be described with reference to FIGS. 4 and 5.

As illustrated in FIG. 4, the scroll compressing unit 130 includes a fixed scroll 103 and an orbiting scroll 104. The scroll compressing unit 130 includes therein a plurality of compression chambers 170. The compression chambers 170 will be described in detail later.

The fixed scroll 103 includes a base plate 103*a* having a lap bottom surface 103*a*1 and a scroll lap 103*b* extending from a lower surface of the base plate 103*a*. The orbiting scroll 104 is a member that includes a base plate 104*a* having a lap bottom surface 104*a*1 and a scroll lap 104*b* extending from an upper surface of the base plate 104*a*.

The scroll lap 103*b* has a scroll flank 103*b*1, a lap flank 103*b*2, and a tip facing the orbiting scroll 104. The scroll lap 104*b* has a scroll flank 104*b*1, a groove 104*b*2, and a tip facing the fixed scroll 103. The scroll lap 104*b* includes raised portions 104*b*3 defined by the groove 104*b*2. The groove 104*b*2 receives a seal 114.

The fixed scroll 103 and the orbiting scroll 104 are arranged such that the scroll lap 103*b* and the scroll lap 104*b* engage with each other. Consequently, the lap bottom surface 103*a*1 faces the lap bottom surface 104*a*1 and the scroll flank 103*b*1 contacts the scroll flank 104*b*1, thus defining the compression chambers 170. The compression chambers 170 include a low pressure chamber 170*a*, an intermediate chamber 170*b*, and a high pressure chamber 170*c* in order of increasing pressure.

As illustrated in FIG. 5, the base plate 103*a* of the fixed scroll 103 has an injection passage 150 extending from a rear surface of the base plate 103*a* toward the scroll lap 103*b*. In other words, the injection passage 150 is formed so as to extend through the base plate 103*a* of the fixed scroll 103 from an upper surface of the base plate 103*a* to the lower surface thereof. The injection passage 150 is connected to an injection pipe 113 so that refrigerant can be directly injected into the intermediate chamber 170*b*. Since the base plate 103*a* has the injection passage 150 as described above, the base plate 103*a* has an opening port 103*c* in the lower surface. In FIG. 5, full-line arrows indicate a direction in which force acts on the seal 14. In addition, the orbiting scroll 4 orbits horizontally as illustrated in FIG. 5.

When the fixed scroll 103 and the orbiting scroll 104 are located as illustrated in FIG. 5, the seal 114 partially closes the injection passage 150 over an angle of substantially 90 degrees of orbital motion (360 degrees) of the orbiting scroll 104. The reason is because, in plan view of the fixed scroll 103, the scroll lap 103*b* of the fixed scroll 103 defining the intermediate chamber 170*b* is located outside the opening port 103*c*.

As described above, when at least part of the seal 114 is located so as to face the injection passage 150 during the orbital motion of the orbiting scroll 104, the force of an injection flow is applied to the seal 114 such that the seal 114 is hindered from floating. If the pressure of fluid injected and a pressure difference for sealing of the seal 114 are out of balance, floating force may fail, thus forming a clearance between the seal 114 and the lap bottom. Since part of the seal 114 facing the injection passage 150 is depressed, surrounding parts of the seal 114 are also depressed to form a clearance, causing loss of sealing. Unfortunately, compressed gas refrigerant may leak inside the compressor, causing loss of power.

Furthermore, under pressure conditions where injection is not used, the seal 114 may enter the injection passage 150 depending on floating force of the seal 114. An edge of the injection passage 50 may damage and break the seal 114 depending on the relationship between the area of the injection passage 150 and the width of the seal 114.

For example, a method of reducing the opening area of the opening port 103*c* or a method of shaping the opening port 103*c* into, for example, an elongated hole by complicated machining without changing the opening area of the opening port 103*c* can be used so that the seal 114 is prevented from facing the opening port 103*c* (injection passage 150). However, any of these methods is undesirable in terms of workability, for example.

In contrast, the compressor 100 according to Embodiment 1 is configured such that the scroll lap 3*b* of the fixed scroll 3 defining the intermediate chamber 70*b* is at least partly located inside the opening port 3*c* in plan view of the fixed scroll 3. This can eliminate or reduce a likelihood that the seal 14 may close the injection passage 50 during one orbit of the orbiting scroll 4 relative to the fixed scroll 3.

This can inhibit inside leakage through a sealing clearance that is formed due to 90-degree displacement of the floating direction of the seal 14 relative to the fluid pressure acting direction of the injection flow. Consequently, the refrigerant can be injected into the intermediate chamber 70*b* without adversely affecting the sealing function of the seal 14.

Additionally, since the compressor 100 according to Embodiment 1 achieves the elimination or reduction of the likelihood that the seal 14 may enter the injection passage 50, this can inhibit breakage of the compressor 100. Thus, the flow rate of injection can be maintained without the need for any complicated machining and without changing the pressure of injection.

Furthermore, in the compressor 100 according to Embodiment 1, if a sliding surface of the seal 14 and the lap flank 3*b*2 of the fixed scroll 3 are at a short distance from each other, a necessary flow rate of injection can be achieved. Additionally, interference between the opening port 3*c* and the seal 14 can be eliminated or reduced under non-injection conditions, thus achieving reliability without any damage to the seal 14.

To allow the injection passage 50 to be substantially circular in cross-section, the fixed scroll 3 is typically machined from the rear surface with a rotary tool. To machine the fixed scroll 3 so that the scroll lap 3*b* of the fixed scroll 3 defining the compression chamber 70 is at least partly located inside the opening port 3*c* in plan view of the fixed scroll 3 as in Embodiment 1, the center of a drill bit of a rotary drill is located at a point located inwardly of the scroll flank in a thickness direction of the scroll lap. This can inhibit deviation of the drill bit, thus enhancing workability. The reason why the center of the drill bit of the rotary drill is located at a point located inwardly of the scroll flank in the thickness direction of the scroll lap is as follows. When the drill bit extending through the base plate 3*a* reaches the scroll flank 3*b*1 to machine part of the flank, part of the rotary drill cutting the scroll lap is under load conditions and part thereof cutting nothing is under no-load conditions, so that the rotary drill tends to deviate to a no-load side. The rotary drill may fail to achieve machining with no deviation, and may be broken during machining.

Figure 6:
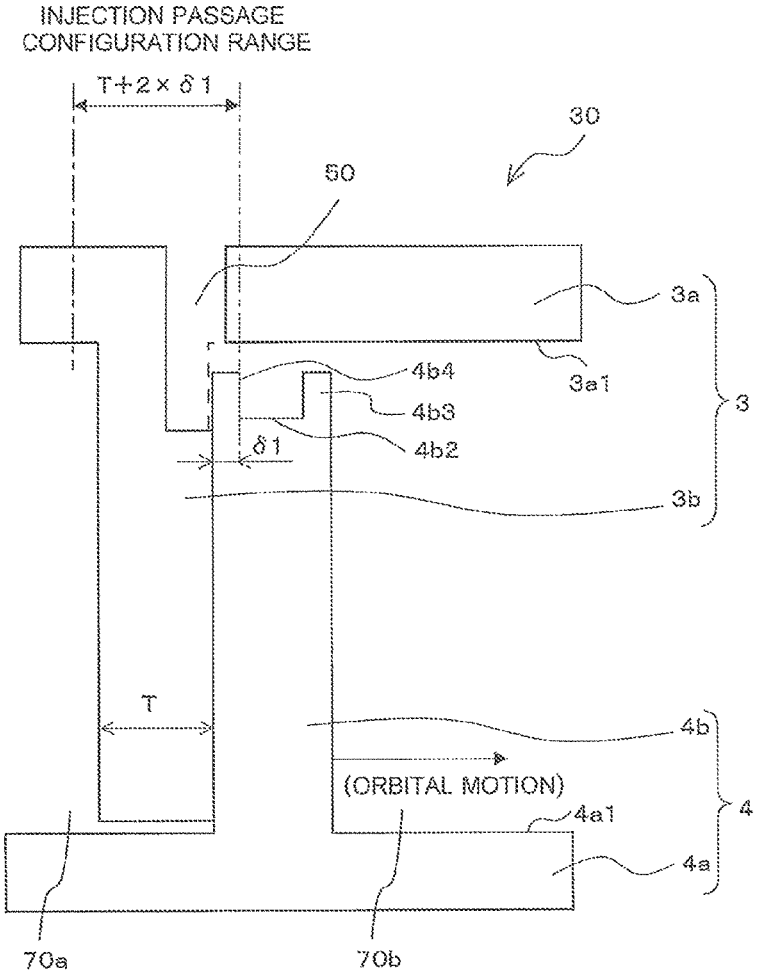
FIG. 6 is an enlarged view of essential part illustrating a range of the injection passage configuration of the compressor 100 according to Embodiment 1 of the present invention.

FIG. 6 is an enlarged view of essential part of a range of the injection passage configuration of the compressor 100 according to Embodiment 1 of the present invention. Referring to FIG. 6, the injection passage 50 is disposed in a range that satisfies ($T+2\times\delta1$), where T denotes the thickness of the scroll lap 3*b* of the fixed scroll 3 and δ1 denotes the thickness of the raised portion 4*b*3 of the orbiting scroll 4.

Figure 7:
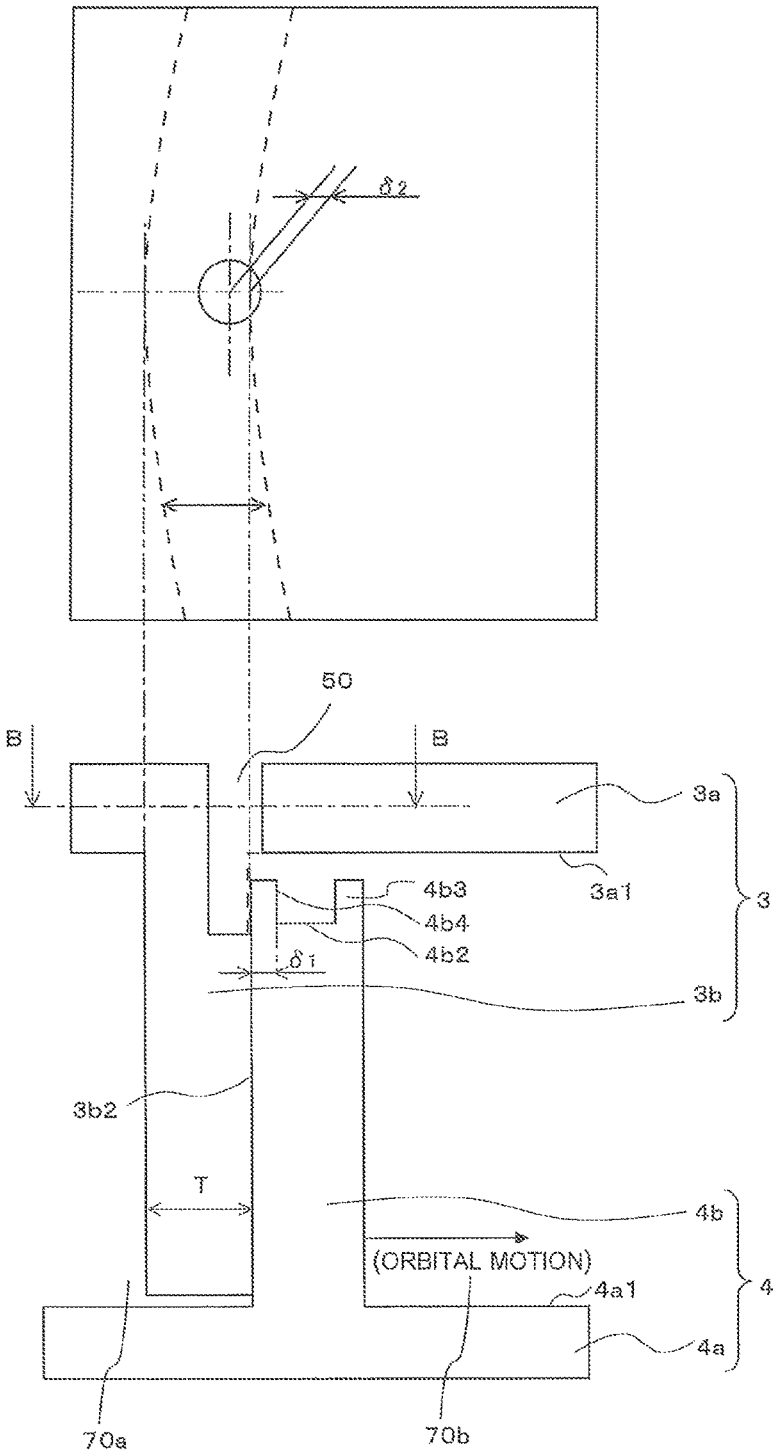
FIG. 7 is an enlarged view of essential part illustrating the positional relationship between a lap flank 3*b*2 and the center of a machined injection passage in the compressor 100 according to Embodiment 1 of the present invention.

FIG. 7 is an enlarged view of essential part of the positional relationship between the lap flank 3*b*2 and the center of a machined injection passage in the compressor 100 according to Embodiment 1 of the present invention. As illustrated in FIG. 7, the injection passage 50 is circular in cross-section (transverse cross-section) parallel to the base plate 3*a*. The center of the circular cross-section is located within two curves obtained by projecting the flanks of the scroll lap 3*b* onto the base plate 3*a*. Furthermore, the injection passage 50 is formed so that a distance δ2 between the center of the circular cross-section and the lap flank 3*b*2 is positive.

In particular, products are now designed to have higher performance. This increases the need for thinner scroll laps made of high-strength materials to reduce leakage loss caused by a pressure difference between adjacent compression chambers. As the scroll laps are thinner, a seal is also reduced in width. The present invention, therefore, can eliminate a risk that a narrower seal enters an injection hole, which has to have an appropriate size as a passage. Furthermore, the recent trend of refrigerant to be used is toward refrigerants (e.g., R32 and 1,1,2-trifluoroethylene) easier to increase in temperature and pressure during compression than conventional refrigerants. The present invention, therefore, can eliminate or reduce an increase in leakage loss caused by an increase in flow rate of injection as well as an increased pressure difference between adjacent compression chambers.

REFERENCE SIGNS LIST

1: sealed container; 2: frame; 3: fixed scroll; 3*a*: base plate; 3*a*1: lap bottom surface; 3*b*: scroll lap; 3*b*1: scroll flank; 3*b*2: lap flank; 3*c*: opening port; 4: orbiting scroll; 4*a*: base plate; 4*a*1: lap bottom surface; 4*b*: scroll lap; 4*b*1: scroll flank; 4*b*2: groove; 4*b*3: raised portion; 5: stator; 6: rotor; 7: main shaft; 8: reservoir; 9: pump; 10: suction pipe; 11: discharge pipe; 13: injection pipe; 14: seal; 30: scroll compressing unit; 40: motor driving unit; 45: Oldham ring; 50: injection passage; 70: compression chamber; 70*a*: low pressure chamber; 70*b*: intermediate chamber; 70*c*: high pressure chamber; 100: compressor; 103: fixed scroll; 103*a*: base plate; 103*a*1: lap bottom surface; 103*b*: scroll lap; 103*b*1: scroll flank; 103*b*2: lap flank; 103*c*: opening port; 104: orbiting scroll; 104*a*: base plate; 104*a*1: lap bottom surface; 104*b*: scroll lap; 104*b*1: scroll flank; 104*b*2: groove; 104*b*3: raised portion; 113: injection pipe; 114: seal; 130: scroll compressing unit; 150: injection passage; 170: compression chamber; 170*a*: low pressure chamber; 170*b*: intermediate chamber; 170*c*: high pressure chamber; T: thickness; δ1: thickness: and δ2: distance.

The invention claimed is:

1. A scroll compressor comprising:

a sealed container;

a fixed scroll disposed within the sealed container, the fixed scroll including a base plate and a scroll lap extending from a lower surface of the base plate of the fixed scroll;

an orbiting scroll disposed within the sealed container, the orbiting scroll including a base plate and a scroll lap extending from an upper surface of the base plate of the orbiting scroll;

a compression chamber defined by engagement of the scroll lap of the fixed scroll and the scroll lap of the orbiting scroll; and an injection passage extending through the base plate of the fixed scroll from an upper surface of the base plate of the fixed scroll to the lower surface of the base plate of the fixed scroll, the injection passage communicating with the compression chamber through an opening port, wherein the opening port is located at least partly inside the scroll lap of the fixed scroll that defines the compression chamber, the scroll lap of the orbiting scroll has a groove longitudinally recessed from a tip of the scroll lap of the orbiting scroll toward the base plate of the orbiting scroll and includes first and second raised portions defined by the groove, the first raised portion is adjacent to the opening port, and the second raised portion is located on an opposite side of the orbiting scroll from the first raised portion, so that the first raised portion is closer to the opening port than the second raised portion, the scroll compressor further includes a seal received in the groove, and the seal is movable between the groove and the lower surface of the base plate of the fixed scroll, the first raised portion has an inner side surface that faces the seal, the first raised portion is located such that the inner side surface of the first raised portion is always out of the opening port in a plan view, wherein a viewing direction of the plan view is perpendicular to the base plate of the fixed scroll, a majority of an outlet of the opening port faces toward the seal, so that injected refrigerant is directed toward the seal, and the injected refrigerant applies force to a side of the seal, in a direction parallel to a plane of the base plate of the fixed scroll.

2. The scroll compressor of claim 1, wherein the injection passage has a circular transverse cross-section, and the circular transverse cross-section has a center located within two curves obtained by projecting flanks of the scroll lap of the fixed scroll onto the base plate of the fixed scroll.

3. The scroll compressor of claim 1, wherein the injected refrigerant used is R32 or 1,1,2-trifluoroethylene.

4. A scroll compressor comprising:

a sealed container;

a fixed scroll disposed within the sealed container, the fixed scroll including a base plate and a scroll lap extending from a lower surface of the base plate of the fixed scroll;

an orbiting scroll disposed within the sealed container, the orbiting scroll including a base plate and a scroll lap extending from an upper surface of the base plate of the orbiting scroll;

a compression chamber defined by engagement of the scroll lap of the fixed scroll and the scroll lap of the orbiting scroll; and an injection passage extending through the base plate of the fixed scroll from an upper surface of the base plate of the fixed scroll to the lower surface of the base plate of the fixed scroll, the injection passage communicating with the compression chamber through an opening port, wherein the opening port is located at least partly inside the scroll lap of the fixed scroll that defines the compression chamber, the scroll lap of the orbiting scroll has a groove longitudinally recessed from a tip of the scroll lap of the orbiting scroll toward the base plate of the orbiting scroll and includes first and second raised portions defined by the groove, the scroll compressor further includes a seal received in the groove, and the seal is movable between the groove and the lower surface of the base plate of the fixed scroll, the first raised portion is adjacent to the opening port, and the second raised portion is located on an opposite side of the orbiting scroll from the first raised portion, so that the first raised portion is closer to the opening port than the second raised portion, the first raised portion has an inner side surface, which faces the seal, and the inner side surface of the first raised portion is always spaced apart from the injection passage in a direction that is parallel to a plane of the base plate of the fixed scroll, a majority of an outlet of the opening port faces toward the seal, so that injected refrigerant is directed toward the seal, and the injected refrigerant applies force to a side of the seal, in the direction parallel to the plane of the base plate of the fixed scroll.

5. The scroll compressor of claim 4, wherein the injection passage has a circular transverse cross-section, and the circular transverse cross-section has a center located within two curves obtained by projecting flanks of the scroll lap of the fixed scroll onto the base plate of the fixed scroll.

6. The scroll compressor of claim 4, wherein the injected refrigerant used is R32 or 1,1,2-trifluoroethylene.

* * * * *